US010820115B2

(12) United States Patent
Zhang

(10) Patent No.: US 10,820,115 B2
(45) Date of Patent: Oct. 27, 2020

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/528,659

(22) Filed: Aug. 1, 2019

(65) Prior Publication Data

US 2020/0045472 A1 Feb. 6, 2020

(30) Foreign Application Priority Data

Aug. 5, 2018 (CN) ..... 2018 2 1252669 U

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 1/02*** | (2006.01) |
| ***H04R 9/04*** | (2006.01) |

(52) U.S. Cl.

CPC ..... *H04R 9/06* (2013.01); *H04R 1/02* (2013.01); *H04R 7/18* (2013.01); *H04R 9/027* (2013.01); *H04R 9/04* (2013.01); *H04R 2400/11* (2013.01); *H04R 2499/11* (2013.01)

(58) Field of Classification Search

CPC ..... H04R 1/02; H04R 2499/11; H04R 9/06; H04R 2400/11; H04R 9/025; H04R 9/027; H04R 7/18; H04R 9/04

USPC ..... 381/332

See application file for complete search history.

(56) References Cited

U.S. PATENT DOCUMENTS 10,250,993 B1 * 4/2019 Xiao ..... H04R 9/06

* cited by examiner

*Primary Examiner* — Paul Kim

(74) *Attorney, Agent, or Firm* — W&G Law Group LLP

(57) ABSTRACT

Provided is a speaker including: a holder having a receiving space; a vibration unit received in the receiving space; and a magnetic circuit unit received in the receiving space and configured to drive the vibration unit to vibrate and sound, the magnetic circuit unit comprising a magnetic frame and a magnet received in the magnetic frame. The magnetic frame includes: a bottom wall connected to the magnet; a sidewall formed by extending from the bottom wall while being bent the vibration unit; and a leakage hole penetrating through the magnetic frame. The leakage hole is provided at a position where the bottom wall and the sidewall are connected and is in communication with the receiving space, and the leakage hole comprises a first portion penetrating through the bottom wall and a second portion penetrating through the sidewall, the first portion and the second portion being in communication with each other.

18 Claims, 5 Drawing Sheets

A–A

SPEAKER

TECHNICAL FIELD

The present disclosure relates to the field of acoustic-electrical conversion, and in particular, to a speaker used in portable electronic products.

BACKGROUND

With the advent of the mobile Internet era, the number of smart mobile devices continues to rise. Among the numerous mobile devices, mobile phones are undoubtedly the most common and portable mobile terminal devices. At present, functions of the mobile phones are extremely diverse, one of which is high-quality music. Therefore, speakers for playing sound are widely used in today's smart mobile devices.

A speaker in the related art includes a holder and a magnetic circuit unit and a vibration unit that are received in the holder. The magnetic circuit unit is used to drive the vibration unit to vibrate and sound and includes a magnetic frame and a magnet that is mounted on the magnetic frame and forming a magnetic gap with the magnetic frame. The vibration unit includes a diaphragm used to vibrate and sound and a voice coil having one end connected to the diaphragm and the other end inserted into the magnetic gap. By applying a current to the voice coil, the voice coil vibrates by being subjected to the Lorentz force in the magnetic field, and drives the diaphragm to vibrate and sound.

However, the magnetic frame backplate of the speaker in the related art is usually provided with a leakage hole for communicating the magnetic gap with external space of the speaker, and when the speaker is assembled in a speaker box, the leakage hole on the magnetic frame backplate is easily blocked by a printed circuit board, which affects the acoustic performance of the speaker and is not conducive to the heat dissipation of the voice coil.

Therefore, it is necessary to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
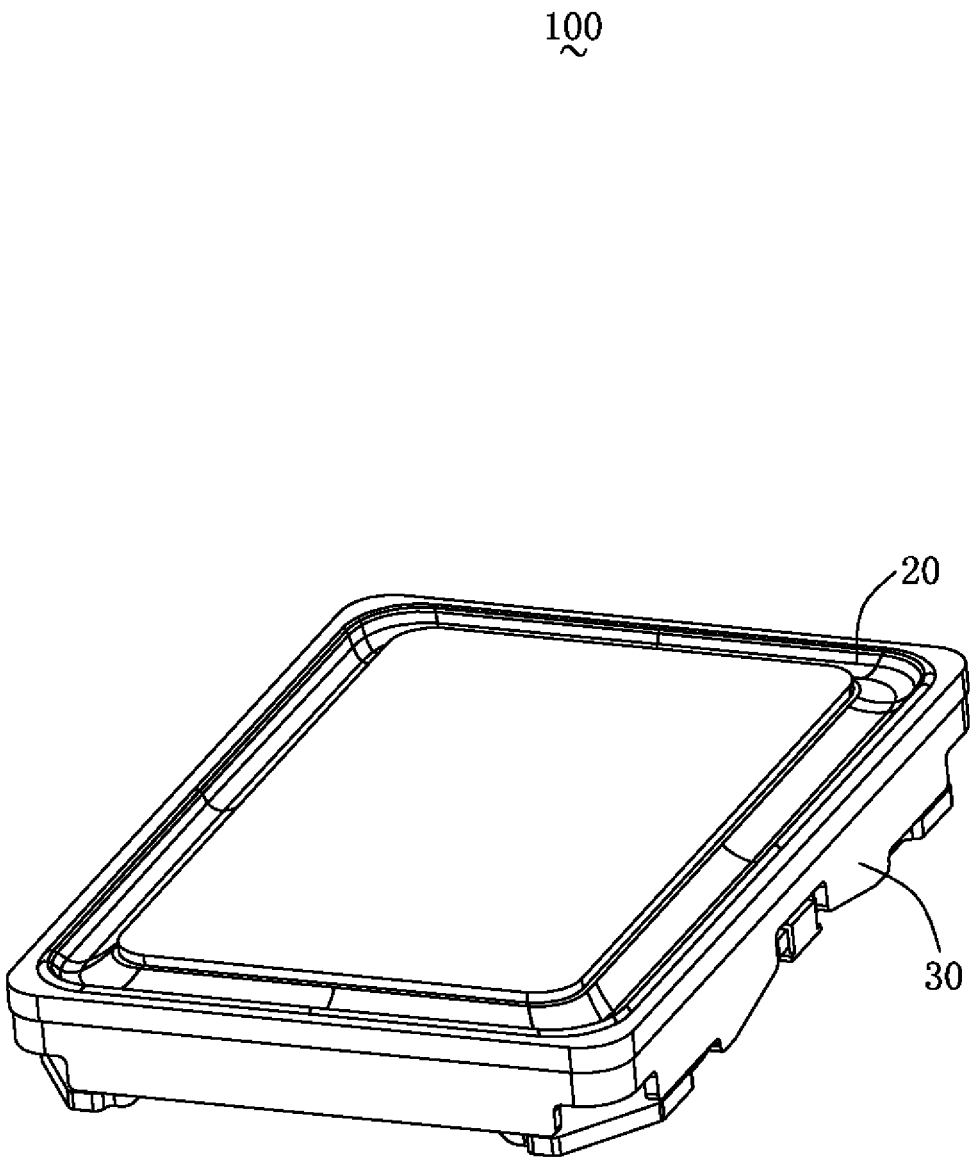
FIG. 1 is a perspective structural schematic diagram of a speaker of the present disclosure.
Figure 2:
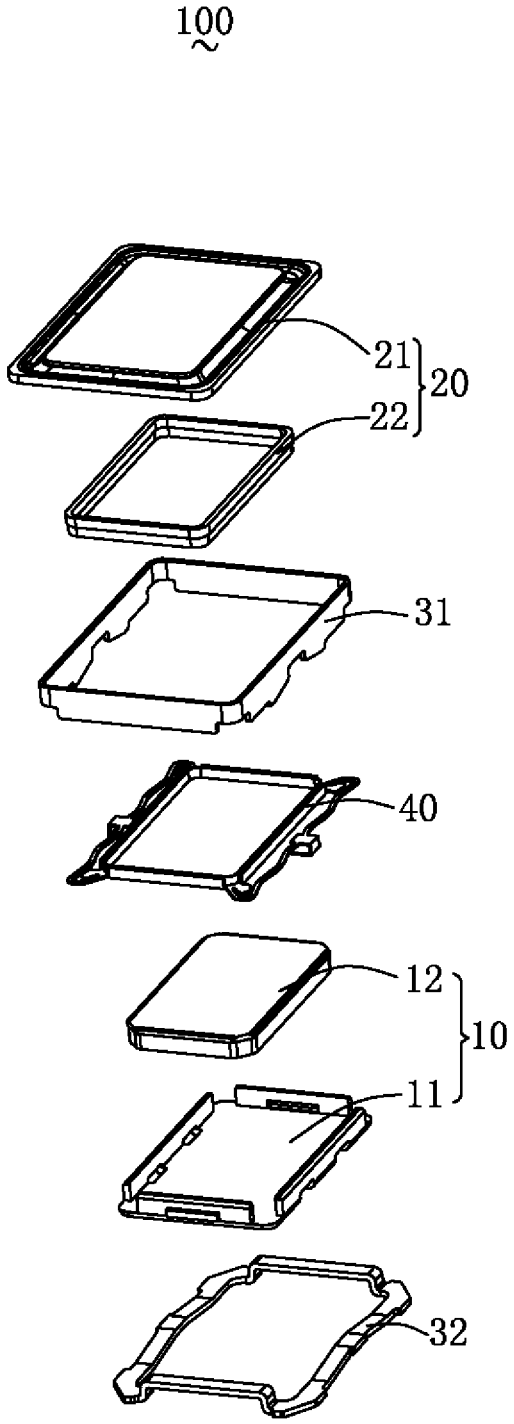
FIG. 2 is an exploded structural schematic diagram of a speaker of the present disclosure.

Please refer to FIG. 1 and FIG. 2. The present disclosure provides a speaker 100 including a magnetic circuit unit 10, a vibration unit 20, a holder 30 having a receiving space and receiving the magnetic circuit unit 10 and the vibration unit 20, and a flexible printed circuit board 40 connected to the vibration unit 20. The magnetic circuit unit 10 is used to drive the vibration unit 20 to vibrate and sound.

The magnetic circuit unit 10 includes a magnetic frame 11 fixed to the holder 30 and a magnet 12 received in the magnetic frame 11.

Figure 3:
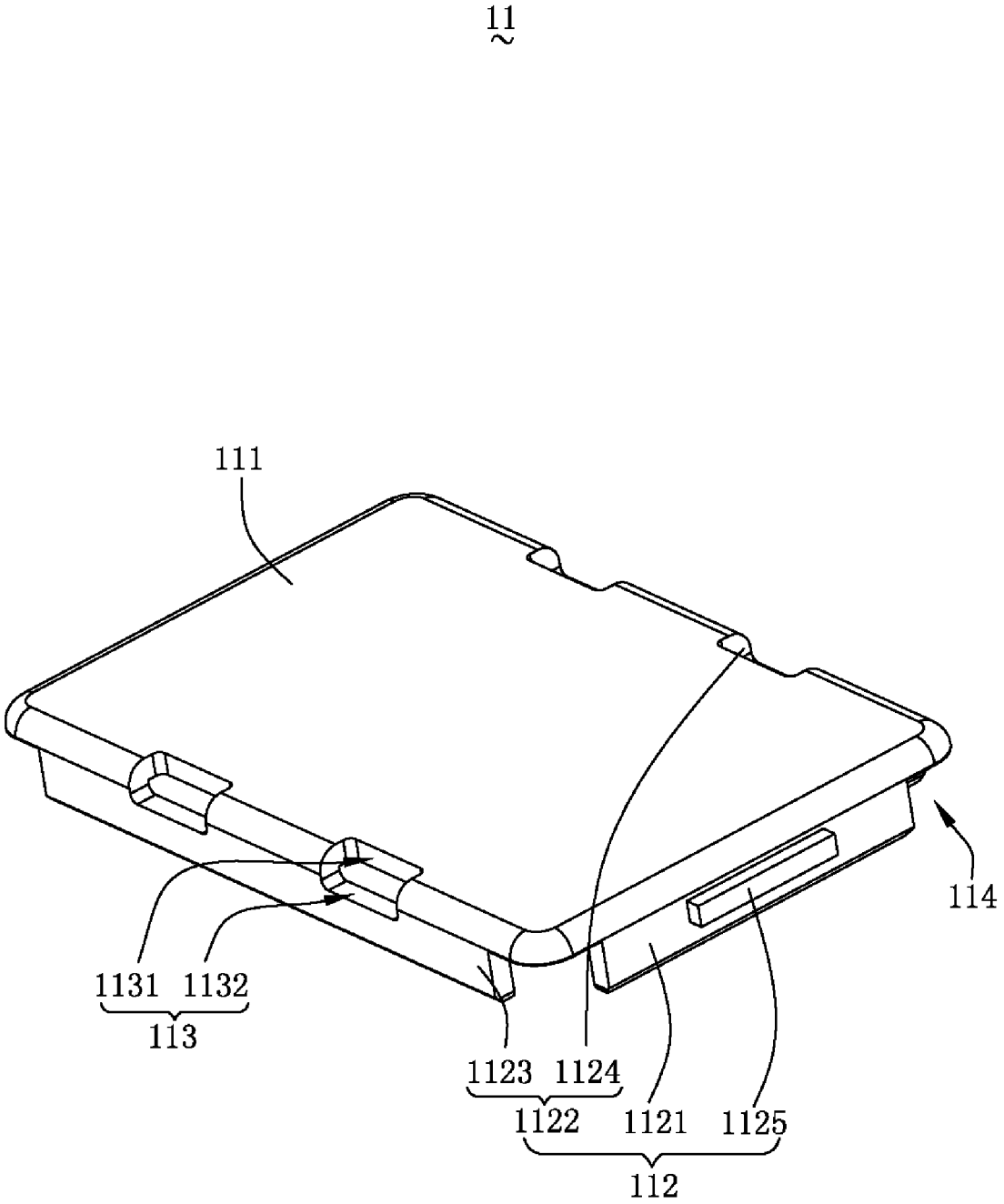
FIG. 3 is a perspective structural schematic diagram of a magnetic frame shown in FIG. 2 when viewed from another angle.

Referring to FIG. 3, the magnetic frame 11 includes a bottom wall 111 that abuts against the magnet 12, a sidewall 112 extending from the bottom wall 111 while being bent towards the vibration unit 20, and a leakage hole 113 penetrating through the magnetic frame 11.

The bottom wall 111 has a rectangular shape, and the sidewall 112 includes a pair of short sidewalls 1121 corresponding to a width direction of the bottom wall 111 and opposite to each other and a pair of long sidewalls 1122 corresponding to a length direction of the bottom wall 111 and opposite to each other. The two short sidewalls 1121 and the two long sidewalls 1122 may be connected end to end to present a rectangular ring structure, or there is a gap between the short sidewalls 1121 and the long sidewalls 1122 without connection. In the present embodiment, gaps 114 exist between the two short sidewalls 1121 and the two long sidewalls 1122, and there are four gaps 114 respectively located at ends of the two short sidewalls 1121 and the two long sidewalls 1122.

The short sidewall 1121 protrudes outwardly from their outer sides facing away from the magnet 12 to form a support portion 1125, and the support portion 1125 is supported on a side of the holder 30 away from the vibration unit 20.

The leakage hole 113 is provided at a position where the bottom wall 111 and the sidewall 112 are connected, and communicates with the receiving space. Specifically, the leakage hole 113 includes a first portion 1131 penetrating through the bottom wall 111 and a second portion 1132 penetrating through the sidewall 112, and the first portion 1131 and the second portion 1132 communicate with each other.

The first portion 1131 and the second portion 1132 are both rectangular, and an area of the first portion 1131 is equal to an area of the second portion 1132.

It can be understood that providing the leakage hole 113 at the position where the bottom wall 111 and the sidewall 112 are connected, i.e., forming the leakage hole 113 by the first portion 1131 and the second portion 1132, can improve the leakage and heat dissipation effect of the speaker 100. Moreover, after the speaker 100 is assembled, even if the printed circuit board is laid on the bottom wall 111 and blocks the first portion 1131, the speaker 100 can still leak and dissipate heat through the second portion 1132, thereby improving the acoustic performance of the speaker 100. In addition, since the leakage hole 113 is formed by partially perforating on the magnetic frame 11, the performance of the speaker 100 will not be affected even if the leakage hole 113 is provided.

The leakage hole 113 may be provided at a position where the long sidewall 1122 and the bottom wall 111 are connected and/or a position where the short sidewall 1121 and the bottom wall 111 are connected. In the present embodiment, the leakage hole 113 is provided at the position where the long sidewall 1122 and the bottom wall 111 are connected.

Specifically, the long sidewall 1122 includes a first long sidewall 1123 and a second long sidewall 1124 opposite to the first long sidewall 1123. There are four leakage holes 113 provided, and these four leakage holes 113 are spaced apart from each other. Two of the leakage holes 113 are located at a position where the first long sidewall 1123 and the bottom wall 111 are connected, and the other two of the leakage holes 113 are located at a position where the second long sidewall 1124 and the bottom wall 111 are connected. The leakage holes 113 located at the position where the first long sidewall 1123 and the bottom wall 111 are connected is right opposite to the leakage holes 113 located at the position where the second long sidewall 1124 and the bottom wall 111 are connected.

The magnet 12 is spaced apart from the sidewall 112 to form a magnetic gap. The leakage hole 113 is in communication with the magnetic gap.

Figure 4:
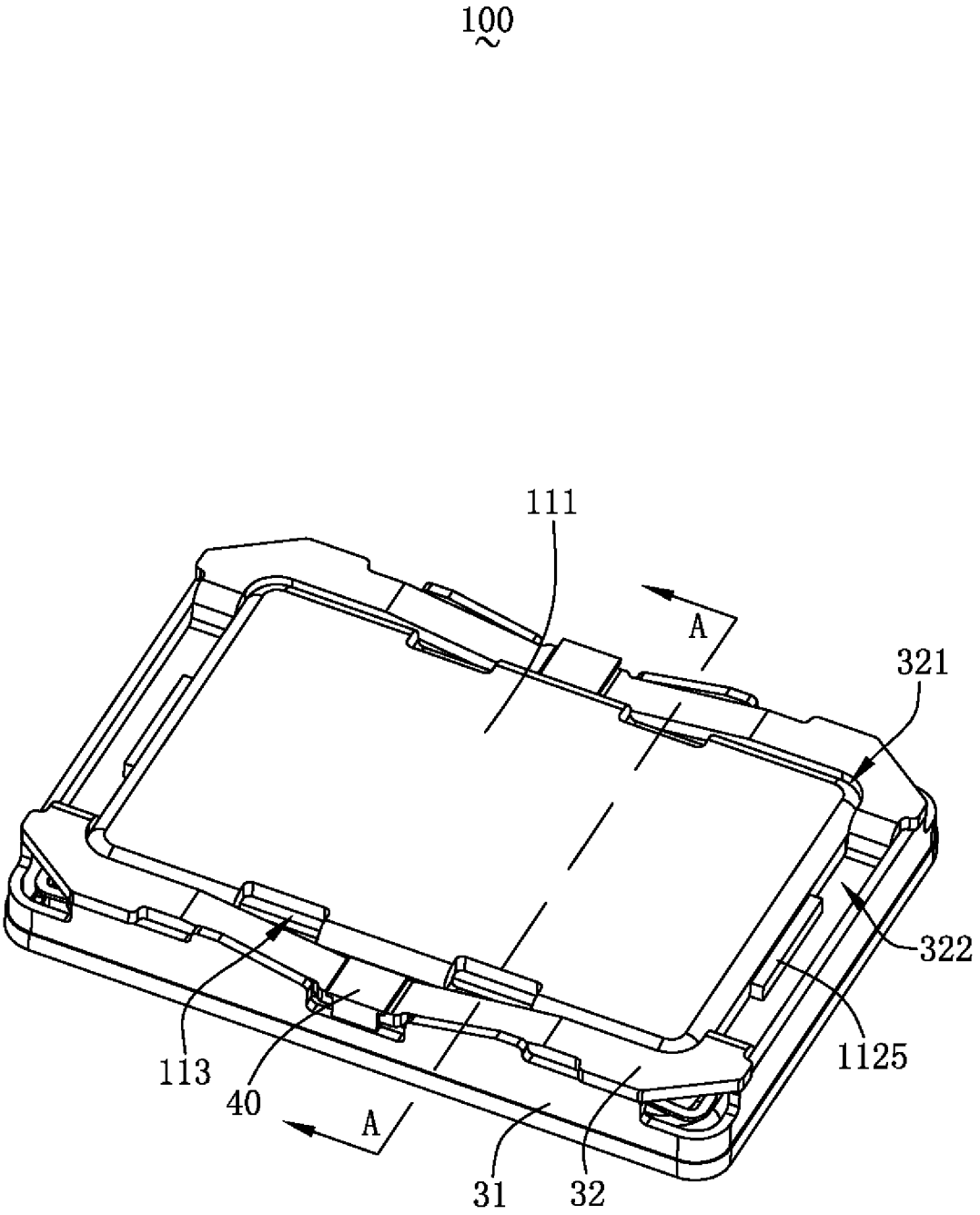
FIG. 4 is a perspective structural schematic diagram of a speaker of the present disclosure when viewed from another angle.
Figure 5:
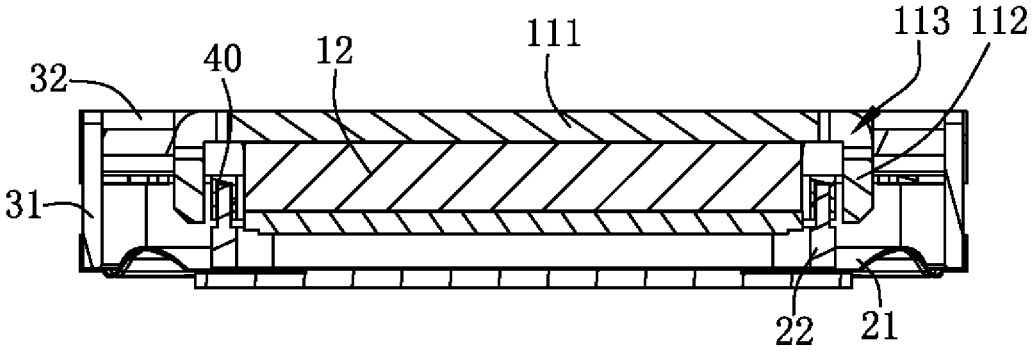
FIG. 5 is a cross-sectional diagram taken along line A-A of FIG. 4.

Referring to FIG. 4 and FIG. 5 in conjunction, the vibration unit 20 includes a diaphragm 21 fixed to the holder 30 and a voice coil 22 disposed on a side of the diaphragm 21 close to the magnetic circuit unit 10.

The voice coil 22 is spaced apart from the bottom wall 111, and an end of the voice coil 22 away from the diaphragm extends into the magnetic gap.

The holder 30 includes an enclosed frame 31 opposite to the sidewall 112 and a bottom plate 32 fixed to an end of the enclosed frame 31 close to the bottom wall 111.

The bottom plate 32 is provided with an opening 321 corresponding to the bottom wall 111, and the bottom wall 111 covers the opening 321 and is fixed to the bottom plate 32. The sidewall 112 extends through the opening while being bent towards the vibration unit 20. At the same time, the bottom plate 32 is recessed at a side away from the vibration unit 20 to form a recess 322. The support portion 1125 is received in the recess 322.

The flexible printed circuit board 40 is connected to the voice coil 22 for communicating the voice coil 22 with an external circuit.

Specifically, the flexible printed circuit board 40 is disposed around the sidewall 112 and inserted, via the gap 114, into space enclosed by the sidewall 112, so as to be connected with the voice coil 22. Moreover, the flexible printed circuit board 40 is fixedly connected to the bottom plate 32.

Compared with the related art, the speaker provided by the present disclosure is provided with the leakage hole located on the magnetic frame and in communication with the receiving space in the holder, and the leakage hole includes the first portion penetrating through the bottom wall and the second portion penetrating through the sidewall, which can improve the leakage and heat dissipation effects of the speaker, thereby improving acoustic performance of the speaker. Moreover, since the leakage hole further includes the second portion penetrating through the sidewall, even if the first portion is blocked after the speaker is assembled, the leakage and heat dissipation of the speaker will not be affected excessively.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a holder having a receiving space;

a vibration unit received in the receiving space; and a magnetic circuit unit received in the receiving space and configured to drive the vibration unit to vibrate and sound, the magnetic circuit unit comprising a magnetic frame and a magnet received in the magnetic frame, wherein the magnetic frame comprises:

a bottom wall connected to the magnet;

a sidewall formed by extending from the bottom wall while being bent towards the vibration unit; and at least one leakage hole penetrating through the magnetic frame, wherein the at least one leakage hole is provided at a position where the bottom wall and the sidewall are connected and is in communication with the receiving space, and each of the at least one leakage hole comprises a first portion penetrating through the bottom wall and a second portion penetrating through the sidewall, the first portion and the second portion being in communication with each other; and wherein the vibration unit comprises a diaphragm fixed to the holder and a voice coil disposed on a side of the diaphragm close to the magnetic circuit unit, a magnetic gap is formed between the sidewall and the magnet, one end of the voice coil away from the diaphragm extends into the magnetic gap, and the at least one leakage hole is in communication with the magnetic gap.

2. The speaker as described in claim 1, wherein the voice coil is spaced apart from the bottom wall.

3. The speaker as described in claim 1, wherein the bottom wall is rectangular, the sidewall comprises a pair of short sidewalls corresponding to a width direction of the bottom wall and arranged opposite to each other and a pair of long sidewalls corresponding to a length direction of the bottom wall and arranged opposite to each other, and the at least one leakage hole is provided at a position where the long sidewalls and the bottom wall are connected and/or a position where the short sidewalls and the bottom wall are connected.

4. The speaker as described in claim 3, wherein the at least one leakage hole is disposed at a position where the long sidewalls and the bottom wall are connected, and the at least one leakage hole comprises a plurality of leakage holes spaced apart from each other.

5. The speaker as described in claim 3, wherein the short sidewalls protrude outwardly from their outer sides facing away from the magnet to form a support portion that is supported on a side of the holder away from the vibration unit.

6. The speaker as described in claim 5, wherein the holder comprises an enclosed frame opposite to the sidewall and a bottom plate fixed to an end of the enclosed frame close to the bottom wall, the bottom plate is provided with an opening corresponding to the bottom wall, the bottom wall covers the opening and is fixed to the bottom plate, and the sidewall extends through the opening while being bent towards the vibration unit.

7. The speaker as described in claim 6, wherein the bottom plate is recessed at its side away from the vibration unit to form a recess in which the support portion is received.

8. The speaker as described in claim 1, wherein the first portion and the second portion are both rectangular.

9. The speaker as described in claim 8, wherein an area of the first portion is equal to an area of the second portion.

10. A speaker, comprising:

a holder having a receiving space;

a vibration unit received in the receiving space; and a magnetic circuit unit received in the receiving space and configured to drive the vibration unit to vibrate and sound, the magnetic circuit unit comprising a magnetic frame and a magnet received in the magnetic frame, wherein the magnetic frame comprises:

a bottom wall connected to the magnet;

a sidewall formed by extending from the bottom wall while being bent towards the vibration unit; and at least one leakage hole penetrating through the magnetic frame, wherein the at least one leakage hole is provided at a position where the bottom wall and the sidewall are connected and is in communication with the receiving space, and each of the at least one leakage hole comprises a first portion penetrating through the bottom wall and a second portion penetrating through the sidewall, the first portion and the second portion being in communication with each other; and wherein the bottom wall is rectangular, the sidewall comprises a pair of short sidewalls corresponding to a width direction of the bottom wall and arranged opposite to each other and a pair of long sidewalls corresponding to a length direction of the bottom wall and arranged opposite to each other, and the at least one leakage hole is provided at a position where the long sidewalls and the bottom wall are connected and/or a position where the short sidewalls and the bottom wall are connected.

11. The speaker as described in claim 10, wherein the vibration unit comprises a diaphragm fixed to the holder and a voice coil disposed on a side of the diaphragm close to the magnetic circuit unit, a magnetic gap is formed between the sidewall and the magnet, one end of the voice coil away from the diaphragm extends into the magnetic gap, and the at least one leakage hole is in communication with the magnetic gap.

12. The speaker as described in claim 11, wherein the voice coil is spaced apart from the bottom wall.

13. The speaker as described in claim 10, wherein the at least one leakage hole is disposed at a position where the long sidewalls and the bottom wall are connected, and the at least one leakage hole comprises a plurality of leakage holes spaced apart from each other.

14. The speaker as described in claim 10, wherein the short sidewalls protrude outwardly from their outer sides facing away from the magnet to form a support portion that is supported on a side of the holder away from the vibration unit.

15. The speaker as described in claim 14, wherein the holder comprises an enclosed frame opposite to the sidewall and a bottom plate fixed to an end of the enclosed frame close to the bottom wall, the bottom plate is provided with an opening corresponding to the bottom wall, the bottom wall covers the opening and is fixed to the bottom plate, and the sidewall extends through the opening while being bent towards the vibration unit.

16. The speaker as described in claim 15, wherein the bottom plate is recessed at its side away from the vibration unit to form a recess in which the support portion is received.

17. The speaker as described in claim 10, wherein the first portion and the second portion are both rectangular.

18. The speaker as described in claim 17, wherein an area of the first portion is equal to an area of the second portion.

* * * * *